US008291830B2

(12) United States Patent
Rutz

(10) Patent No.: US 8,291,830 B2
(45) Date of Patent: Oct. 23, 2012

(54) FOLDING TABLE

(75) Inventor: Josef Rutz, Rosenheim (DE)

(73) Assignee: Steelcase Werndl AG, Rosenheim (DE)

( * ) Notice: Subject to any disclaimer, the term of this patent is extended or adjusted under 35 U.S.C. 154(b) by 152 days.

(21) Appl. No.: 12/757,083

(22) Filed: Apr. 9, 2010

(65) Prior Publication Data

US 2010/0258042 A1 Oct. 14, 2010

(30) Foreign Application Priority Data

Apr. 9, 2009 (EP) ..... 09005248

(51) Int. Cl.
*A47F 5/12* (2006.01)

(52) U.S. Cl. ..... 108/7; 108/115; 108/8

(58) Field of Classification Search ..... 108/115, 108/91, 6–8; 312/319.9; 74/481, 479.01, 74/512, 543; 248/166, 439
See application file for complete search history.

(56) References Cited

U.S. PATENT DOCUMENTS

| | | | | |
|---|---|---|---|---|
| 553,184 | A * | 1/1896 | Burns | 108/11 |
| 3,640,228 | A * | 2/1972 | Busse | 108/6 |
| 4,879,954 | A * | 11/1989 | Sawamura et al. | 108/6 |
| 6,336,414 | B1 * | 1/2002 | Stewart et al. | 108/50.02 |
| 6,343,834 | B1 * | 2/2002 | Wurmlinger | 297/14 |
| 6,637,352 | B1 * | 10/2003 | Thode et al. | 108/132 |
| 7,066,098 | B2 * | 6/2006 | Blasen et al. | 108/115 |
| 7,677,184 | B2 * | 3/2010 | Dhanoa et al. | 108/115 |
| 7,765,938 | B2 * | 8/2010 | Piretti | 108/115 |
| 7,878,128 | B2 * | 2/2011 | Watson et al. | 108/132 |
| 2007/0209559 | A1 * | 9/2007 | Mockel | 108/115 |
| 2008/0149002 | A1 * | 6/2008 | Gardner | 108/6 |
| 2008/0178778 | A1 * | 7/2008 | Koning et al. | 108/132 |
| 2010/0258042 | A1 * | 10/2010 | Rutz | 108/115 |
| 2011/0017107 | A1 * | 1/2011 | Ko | 108/64 |
| 2011/0139042 | A1 * | 6/2011 | Korb | 108/115 |

FOREIGN PATENT DOCUMENTS

| | | |
|---|---|---|
| DE | 1 885 004 | 12/1963 |
| DE | 20 2006 003 762 | 8/2007 |
| EP | 1 308 109 | 8/2004 |
| EP | 1 829 461 | 9/2007 |
| EP | 1 958 537 | 8/2008 |
| EP | 1 836 926 | 6/2009 |

OTHER PUBLICATIONS

EPO machine tranlation of EP 1308109.*

* cited by examiner

*Primary Examiner* — Janet M Wilkens
*Assistant Examiner* — Daniel Rohrhoff
(74) *Attorney, Agent, or Firm* — Nixon & Vanderhye P.C.

(57) ABSTRACT

An improved folding table is distinguished by the following features:

a locking means is provided, by means of which the table top (5) can be locked in the work or use position thereof and in the storage position thereof, the locking means can be unlocked by means of a disengagement means (15), as well as the hand-actuatable disengagement means (15*a*), a further foot-actuatable or shoe-actuatable disengagement means (15*b*) is provided, and the at least one further foot-actuatable or shoe-actuatable disengagement means (15*b*) is provided on the underside of the table on the table half which is lower than the pivot axis of the table top (5) and/or is lower than the hand-actuatable disengagement means (15*a*) when the table top (5) is pivoted into the storage position.

10 Claims, 8 Drawing Sheets

FOLDING TABLE

This application claims priority to EP Patent Application No. 09 005 248.1-2313 filed 9 Apr. 2009, the entire contents of which is hereby incorporated by reference.

BACKGROUND AND SUMMARY OF THE INVENTION

The invention relates to a folding table.

For example, EP 1 308 109 discloses a folding table. This folding table comprises a support frame, which is mounted in vertical support columns at each end face. The folding table can thus be locked in a horizontal work position. So that the table can be stored away in a space-saving manner, the table top can be brought into a storage position, in which the work surface is folded more or less in the vertical direction.

The work surface can be locked in the horizontal work position, but also in the vertical storage position, by a locking means. To pivot the table top from one position into the other, a handle connected to a locking mechanism is thus provided, offset slightly towards the centre of the table, on the underside of the table top alongside each longitudinal edge of the table top. By pulling the handle towards the longitudinal edge of the table, the locking mechanism is released, in such a way that the work surface can be rotated, for example from the horizontal or at least approximately horizontal work position thereof into the vertical or approximately vertical pivot position. If the table top is to be pivoted back into the horizontal use position, the respective upward handle located on the underside of the table top is gripped and pulled upwards (actuating the unlocking) and the table top is pivoted into the horizontal position.

The object of the present invention is to provide an unlocking mechanism for a folding table which is improved by comparison.

The present invention provides a considerable improvement in the handling of a corresponding folding table by simple means.

In the conventional solution, it was indeed possible to pivot the table top of the folding table for example in one or the opposite direction starting from the horizontal work position thereof into a more or less vertical storage position. However, to release the locking, a respective corresponding handle on the underside of the table top had to be pulled to initiate the unlocking process. This was equally the case when the work surface was located in the at least approximately vertical storage position thereof. In this case too, the disengagement handle located somewhat below the upper delimiting edge, extending in the longitudinal direction of the table, had to be gripped and pulled towards the upper edge of the table to initiate the unlocking process and subsequently to pivot the table top back into the horizontal work position.

By contrast, the solution according to the invention consists in that a disengagement portion which can be actuated by foot is provided for initiating the unlocking process in the latter case. In other words, a table top located in the vertical storage position may for example be gripped in the region of the upper longitudinal edge thereof, thus holding the table and preventing it from rolling away, while simultaneously depressing with a shoe the actuation portion, positioned adjacent to the lower table edge, of the unlocking means, in order to pivot the table top from the approximately vertical orientation thereof in the storage position into the approximately horizontal orientation thereof in the conventional use position. This is found in practice to be far easier and more natural than pulling an upper handle upwards.

If the table is pivotable about the horizontal axis thereof in both directions, corresponding unlocking handles or portions are provided on the table top directly alongside the two opposed longitudinal edges. For a table top located in the vertical storage position, it would therefore in principle be conceivable, instead of pulling the upper handle, to actuate the lower handle, which is actually intended for the manual unlocking process, by foot, i.e. with a shoe. However, this is to be avoided for reasons of hygiene, since the unlocking means would then be disengaged by foot at some times and be gripped by hand at other times, specifically if the relevant table top were located in the horizontal locked position thereof, in which the unlocking means would always be disengaged or actuated by hand.

Therefore, in a particularly preferred embodiment of the invention, two actuation portions arranged mutually offset in the transverse direction of the table are thus provided on each table half on the underside of the table top, specifically a manual, i.e. hand-actuatable unlocking or disengagement means and a foot-actuatable unlocking or disengagement means. Whenever the table top is located in the approximately vertical storage position thereof, unlocking can be actuated via the pedal located on the underside of the table alongside the lower longitudinal table edge. In other words, by pressing with a shoe on the aforementioned disengagement portion provided for this purpose, the corresponding unlocking mechanism can be adjusted against the force of a spring means. This unlocking process is far easier to carry out than that in the previous situation, where if the table top were located in the vertical storage position thereof, the manual unlocking means alongside the upper longitudinal edge of the table had to be pulled upwards to carry out the unlocking process against the force of a spring means.

A further improvement results if the foot-actuated disengagement portion of the unlocking means is of a larger size, above all projecting further from the underside of the table, than the corresponding actuation portion for manual disengagement. In this way, it can reliably be ensured in particular that the sole of the shoe only ever reaches and actuates the disengagement pedal of the unlocking means and those portions of the actuation means to be disengaged by hand cannot be soiled.

This last variant is preferred, although it would also be possible in principle to provide disengagement means, for actuation by foot and by hand respectively, which were arranged spatially separated in the longitudinal direction of the table.

BRIEF DESCRIPTION OF THE DRAWINGS

The invention is explained in greater detail in the following by way of embodiments, in which, specifically.

DETAILED DESCRIPTION OF THE INVENTION

Figure 1:
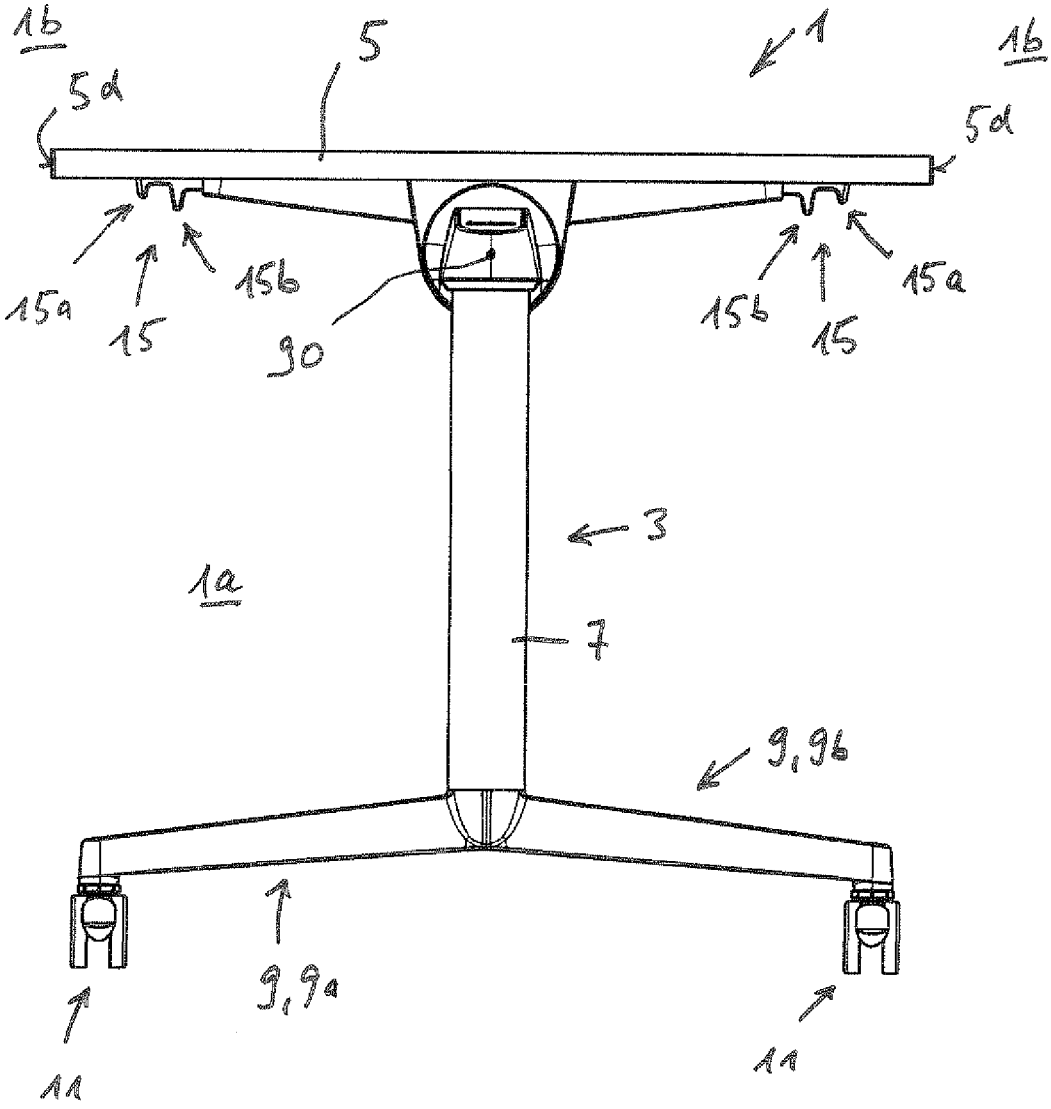
FIG. 1 is a schematic end view of a folding table which can be pivoted about a horizontal axis in both directions, with an unlocking device according to the invention provided on the underside of the table.

FIG. 1 shows for example the right-hand end face 1*a* of a folding table 1. It can be seen from this figure and from the other figures that the folding table 1 comprises an upwards-facing table top 5, which in FIG. 1*a* is located in the generally horizontally oriented work and use position thereof. Other different work positions which can be set slightly obliquely or like a desk, and in which the table top can optionally be set at a small angle to the horizontal plane and locked in this position, are also optionally possible.

The support means 3 is provided at each of the two opposite end faces 1*a* and in the embodiment shown comprises a respective support column 7, which transitions downwards into a support base 9, which comprises support base portions 9*a* and 9*b* projecting on either side of the support column 7. In the embodiment shown, the two support base portions 9*a* and 9*b* each extend radially from the support column, resulting in a continuous, straight support base formed from the two portions 9*a* and 9*b*. The support base portions 9*a*, 9*b* may however also be oriented at an angle to one another or be of a shape deviating from a straight line.

A roller arrangement 11 is provided on each of the opposite ends of the support bases 9 and is conventionally provided with a fixing or releasing mechanism. This means that the folding table can be moved to any desired location use or to a location for storage without difficulty. In each desired work position it can be ensured, by actuating the locking mechanisms 11 integrated into the rollers, that the table is not moved accidentally.

Figure 2A:
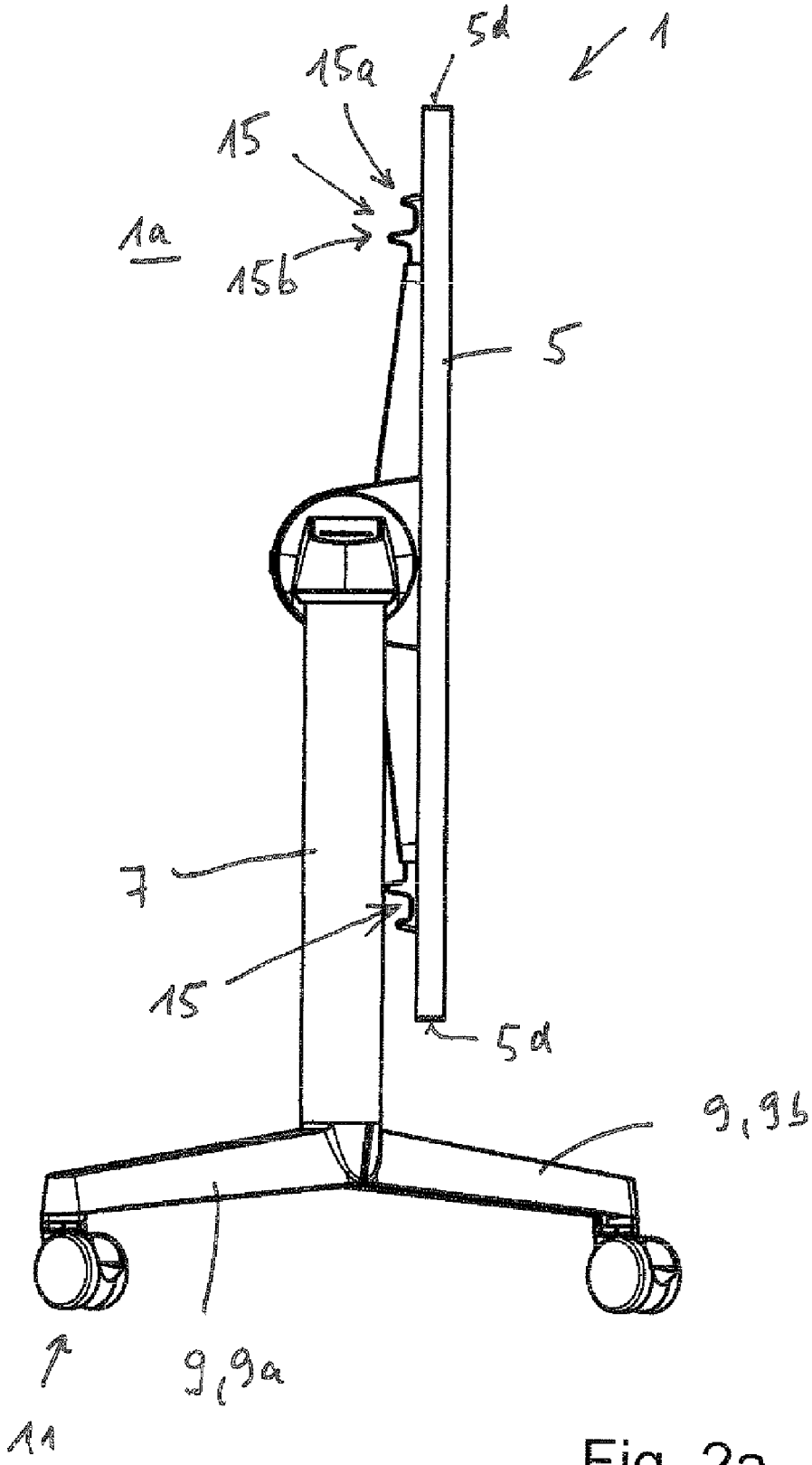
FIG. 2*a* is a schematic end view of the folding table in a position in which the table top is pivoted in the at least approximately vertically extending storage position, pivoted to the right.
Figure 2B:
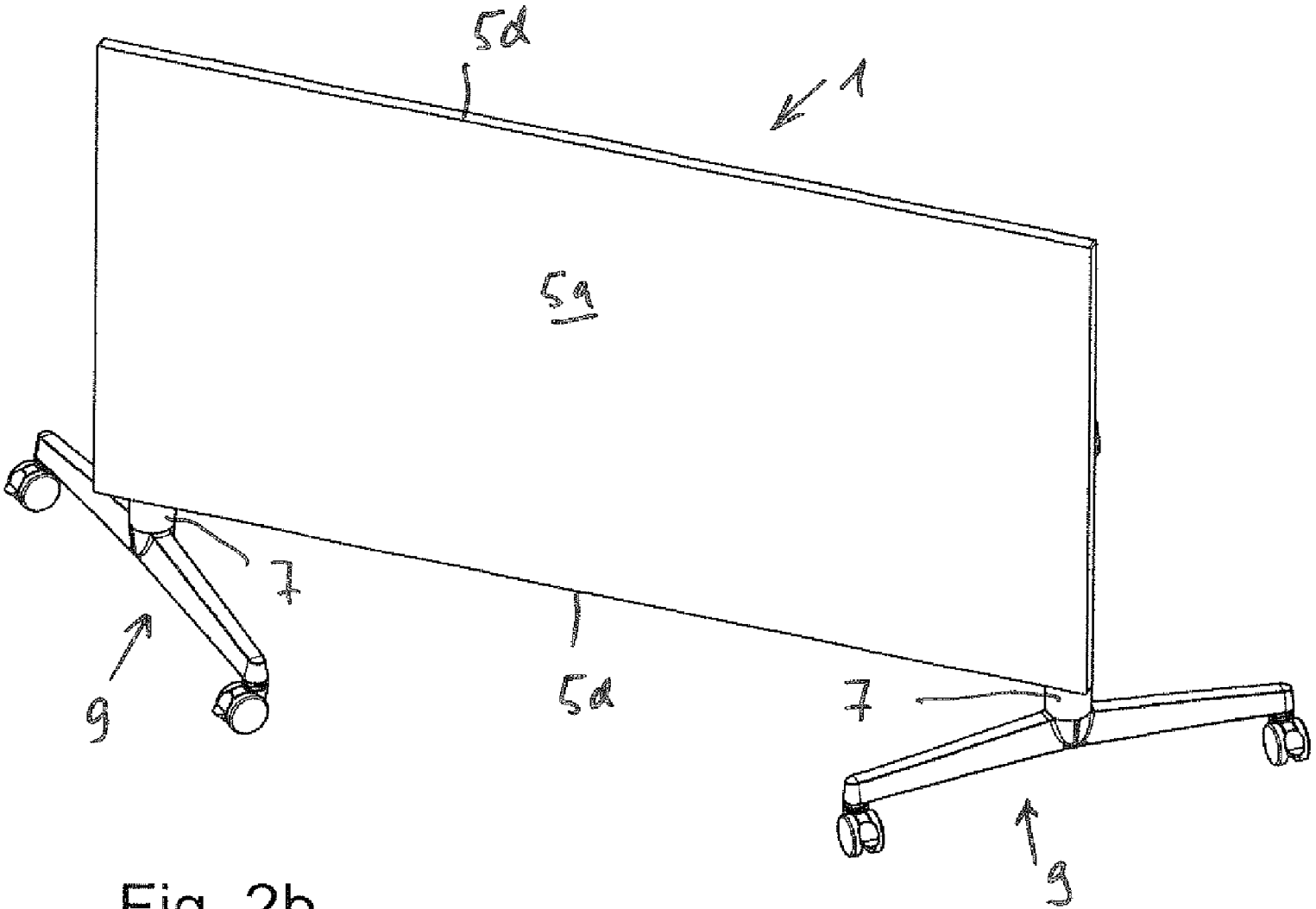
FIG. 2*b* is a side view of the table shown in FIG. 2*a* with the work surface thereof folded into the storage position.

FIG. 2*a* reproduces the right-hand end face 1*a* of the table as shown in FIG. 1, with the table top brought into the vertically extending storage position arranged on the right. FIG. 2*b* thus shows the table from the side, i.e. with the upper face 5*a* of the table top 5 of said table facing towards the viewer.

Figure 3A:
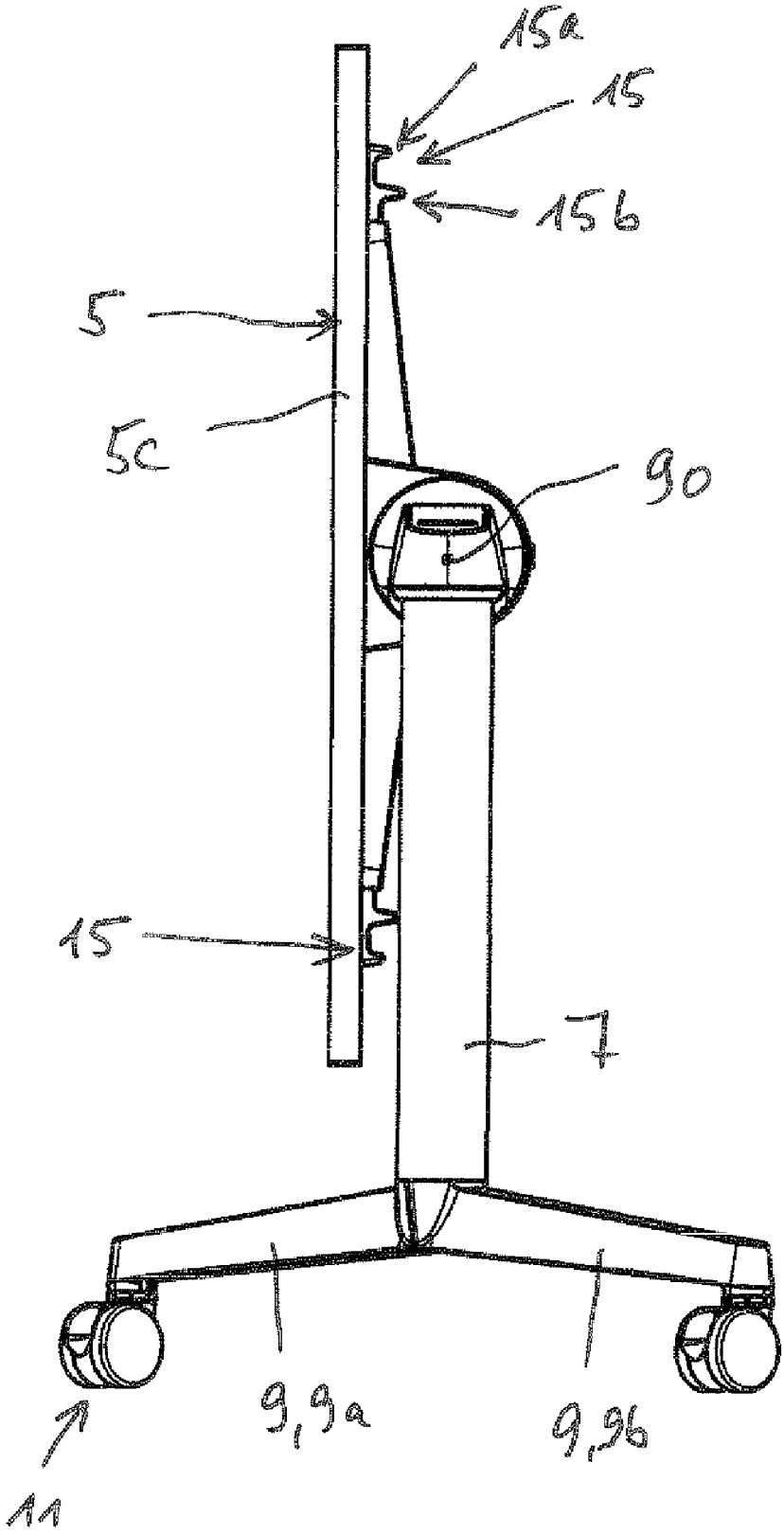
FIG. 3*a* is an end view comparable to FIG. 2*a*, in which the table top is pivoted into the opposite storage position.
Figure 3B:
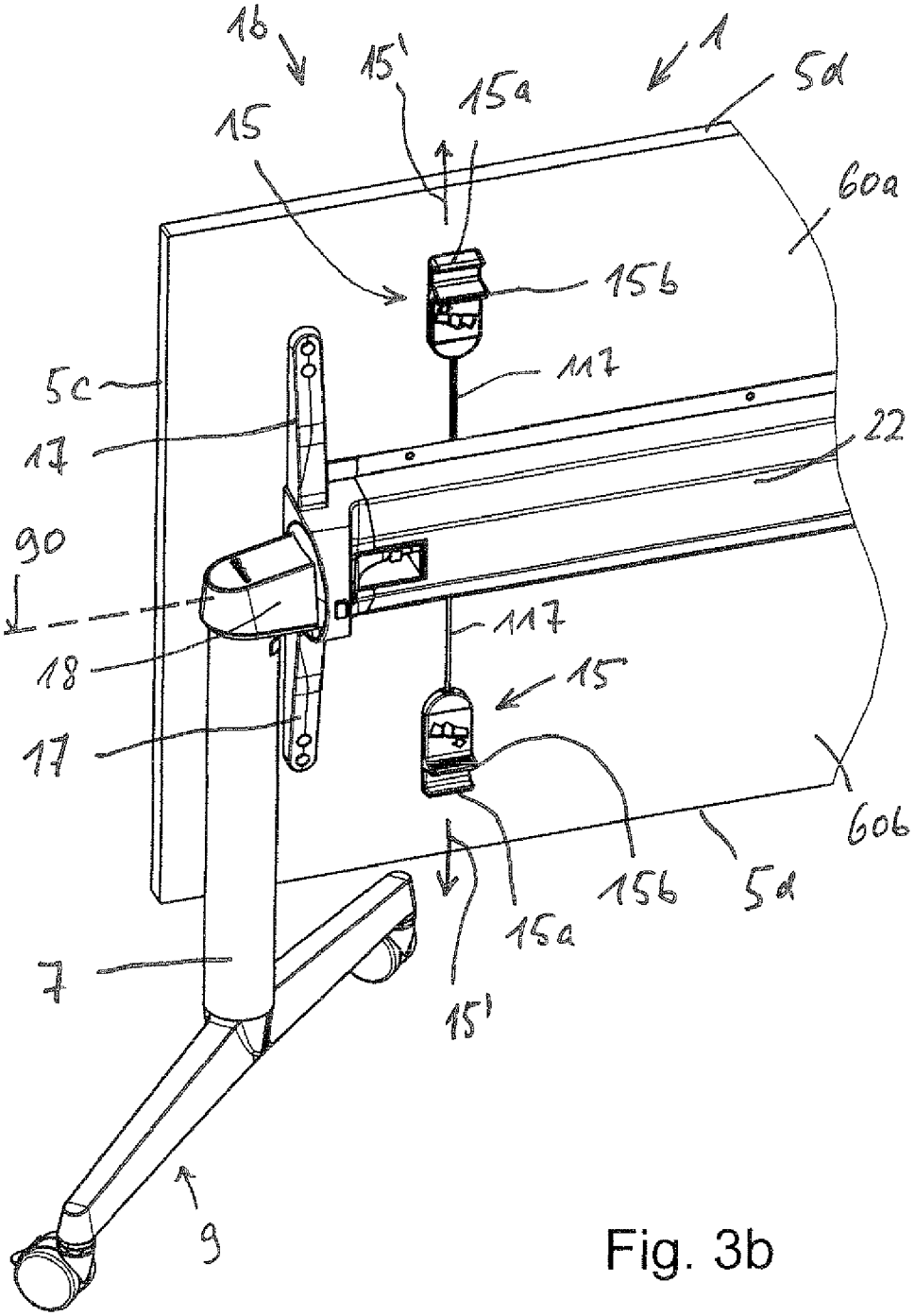
FIG. 3*b* is a rear view of part of the folding table shown in FIG. 3*a* with the work surface folded into the storage position.

In FIG. 3*a*, by contrast with FIG. 2*a*, the table top 5 has been brought into the opposite pivot position, and FIG. 3*b* is a view from below, in the direction of the arrow III shown in FIG. 3*a*, of part of the underside 5*b* of the table top 5 when folded into the storage position. It can be seen from the figures that in the work position the support bases 9 preferably extend parallel to the end face 5*c* of the table top, i.e. perpendicular to the longitudinal direction of the table, whereas when the table top is folded into the storage position (in which it extends more or less vertically), the support bases 9 have been rotated through an angular range about the axis of rotation formed by the support column 7, specifically in such a way that the support bases 9*a* on the side towards which the upper face 5*a* of the table top 5 faces extend towards one another, whereas the support base portions 9*b* on the side towards which the underside 5*b* of the table top 5 faces extend away from one another, i.e. are further apart. This has the advantage that a person who grips the table top from a longitudinal side can pivot said table top away from himself into the vertical storage position without difficulty, and thus the support base portions 9*a* and 9*b* on the side where the person is standing are pivoted away from one another and are pivoted towards one another on the opposite side, and this additionally simplifies the handling.

Preferably, the horizontal pivot axis or pivot means of the table top 5 is coupled to the base means which projects transversely underneath the columns 7, in such a way that when the table top is pivoted, corresponding pivoting of the support base portions 9*a* and 9*b* preferably also takes place. On this point. reference is made to the known solution. The imaginary horizontal pivot axis 90 is shown in the figures independent of a constructional solution or rearrangement. In the embodiment shown, the pivot axis 90 extends in the longitudinal direction of the table top 5, forming a first table top half 60*a* and a second table top half 60*b* which is positioned on the other side of the pivot axis 90.

Purely for the sake of general completeness it is further noted, referring to FIG. 3*b*, that the table top 5 may for example be supported by a substructure, which, offset in the longitudinal direction of the table top in the region towards the end faces of the table top 5, in each case opens into two transverse supports 17 which extend in opposite directions and on which the table top rests. By means of the shared support construction, the table top can be pivoted relative to a bracing or supporting head 18 about a horizontal axis 90, for example between the conventional horizontally oriented work position (or a pre-selectable work position at a slight angle to the horizontal) and the storage position shown in FIG. 3*b*. Thus, FIG. 3*b* also shows a further cable channel 22 extending in the longitudinal direction of the table top on the underside of the table top.

The table top 5 is to be locked, at least in the single work position thereof, conventionally in the horizontal position, by a locking mechanism, in such a way that pivoting is reliably prevented. The type of locking mechanism will be discussed further below. In this case, measures may also be taken to ensure that in the predetermined position, or a plurality of positions, at a slight angle to the horizontal plane, the table top can be brought into a locked work position.

So that the work surface 5 can be folded into the storage position from either longitudinal side 1*b* of the folding table 1, a disengagement and/or actuation mechanism 15 is provided on the two opposed longitudinal sides 1*a* of the folding table on the underside 5*b* of the table top 5. If this disengagement or actuation mechanism 15 is for example pulled towards the adjacent longitudinal edge 5*d* of the table top 5, this releases a locking mechanism in such a way that a table top located in the work position can be pivoted into the storage position thereof, pivoted through 90° for example, or conversely from the storage position thereof into the at least approximately horizontal work or use position thereof.

For this purpose, the disengagement and/or actuation mechanism 15 comprises at least one first, hand-actuatable disengagement portion 15*a* and at least one second, foot-actuatable or shoe-actuatable disengagement portion 15*b*, allowing the mechanism to be moved in the direction of the arrow 15', generally against the force for example of a spring means (not shown in greater detail).

Figure 4:
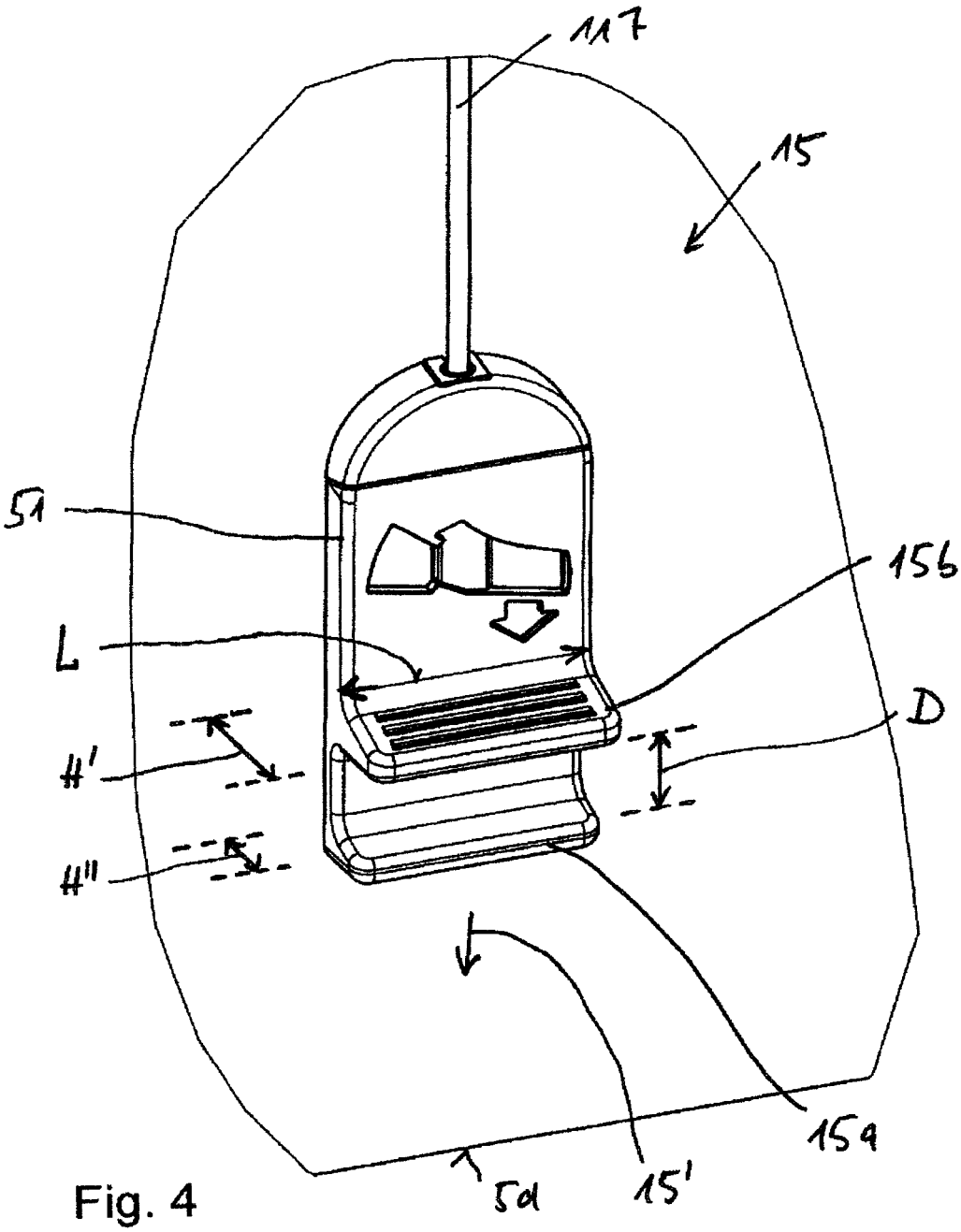
FIG. 4 is a schematic, enlarged view of part of an actuation and disengagement means according to the invention.

As can be seen in particular from the enlarged detail of FIG. 4, the disengagement and/or actuation mechanism 15 comprises a base member 51, on which are formed the aforementioned first disengagement portion 15*a* and the second disengagement portion 15*b* which is adjacent thereto at a distance D (i.e. extending transverse to the longitudinal direction of the table or transverse to the horizontal pivot axis 90).

However, FIG. 4 also shows that the base member 51 is or may be formed approximately in a plate shape, in particular with the principal orientation thereof parallel to the table top.

The two disengagement portions 15*a* and 15*b* project in front of this base member transverse and preferably perpendicular to the plate of the table top. If the table top is rotated into the more or less vertical storage position, the disengagement portions 15*a* and 15*b* are thus more or less horizontal and can be reached and disengaged optimally because the actuation surfaces thereof are oriented transverse, i.e. more or less perpendicular, to the plane of the table top.

As can also be seen from the embodiment, the second, foot-actuatable disengagement portion 15*b* is in the form of a rib or web and comprises a raised portion H" which is substantially larger than the raised portion H' of the first, hand-actuatable disengagement portion 15*a*, which also is or can be in the form of a web. This foot-actuatable disengagement portion 15*b* is closer than the hand-actuatable disengagement portion 15*a* to the horizontal pivot axis 90 and thus further from the adjacent longitudinal side 5*d*, shown at the bottom in FIG. 4, of the table top 5.

As is shown in FIG. 3*b*, this provides the possibility, for example for pivoting the more or less vertically oriented work surface 5 positioned in the storage position, of gripping the upper longitudinal edge 5*d* of the table and actuating the disengagement web 15*b* in the disengagement direction 15' with the sole of a shoe against the force of a spring means (not shown in greater detail). This unlocks the horizontal axis, which is generally retained so as to be rotatable on the upper end of the vertical rotation columns 7, of the table top 5, for example by sliding a pin out of a catch opening against an integrated spring means. Once the table starts to rotate, the actuation means can be let go again and is returned into the starting position by the aforementioned spring means.

If the table is located in the horizontal position thereof, the hand-actuatable disengagement means 15*a* may for example be gripped from behind and the disengagement and/or actuation means 15 as a whole can be moved towards the adjacent table edge 5*d* against the force of the spring means (not shown) so as to undo the locking in this position and tilt the table top back into the approximately vertically extending storage position shown in FIGS. 3*a* and 3*b*.

This "double grip" construction means that a manual disengagement portion 15*a* and a foot-operated disengagement portion 15*b* are provided in such a way as automatically and intuitively to be operated correctly, the foot-operated disengagement portion 15*b* always being positioned before the manual disengagement portion 15*a* in the actuation direction, so as to protect it, when the table top is oriented vertically. The disengagement portion 15*a* which is otherwise hand-actuatable therefore cannot be soiled by the sole of the shoe.

By contrast with the embodiment, the total length L of the disengagement and/or actuation means or at least the disengagement portion 15*b* intended for actuation by foot may be greater than the length of the disengagement and/or actuation means 15*a* for manual disengagement, in such a way that there is also no possibility of the manual disengagement portion 15*a* being engaged laterally by the shoe or the sole of the shoe.

In the embodiment shown, the actuation or disengagement means 15 consists of a single-piece component, which comprises two web portions 15*a* and 15*b* having a base member 51, the two disengagement portions 15*a* and 15*b* which are raised more or less perpendicular or transverse to the plane of the table top extending transverse to a base portion 115 of the actuation or disengagement means 15, which base portion projects by a particular distance on the actuation side of the foot disengagement portion 15*b* in the embodiment shown. The disengagement or actuation member 15 formed in this way may be guided in a corresponding guide or in a counter piece in such a way that the adjustment can preferably be carried out only in the disengagement direction 15', as with a displaceable slide. This is merely shown by way of the guide and/or force transmission means 117. The restoring movement is brought about in the opposite direction by the spring means (not shown) and/or another force storing means, generally automatically.

Figure 5:
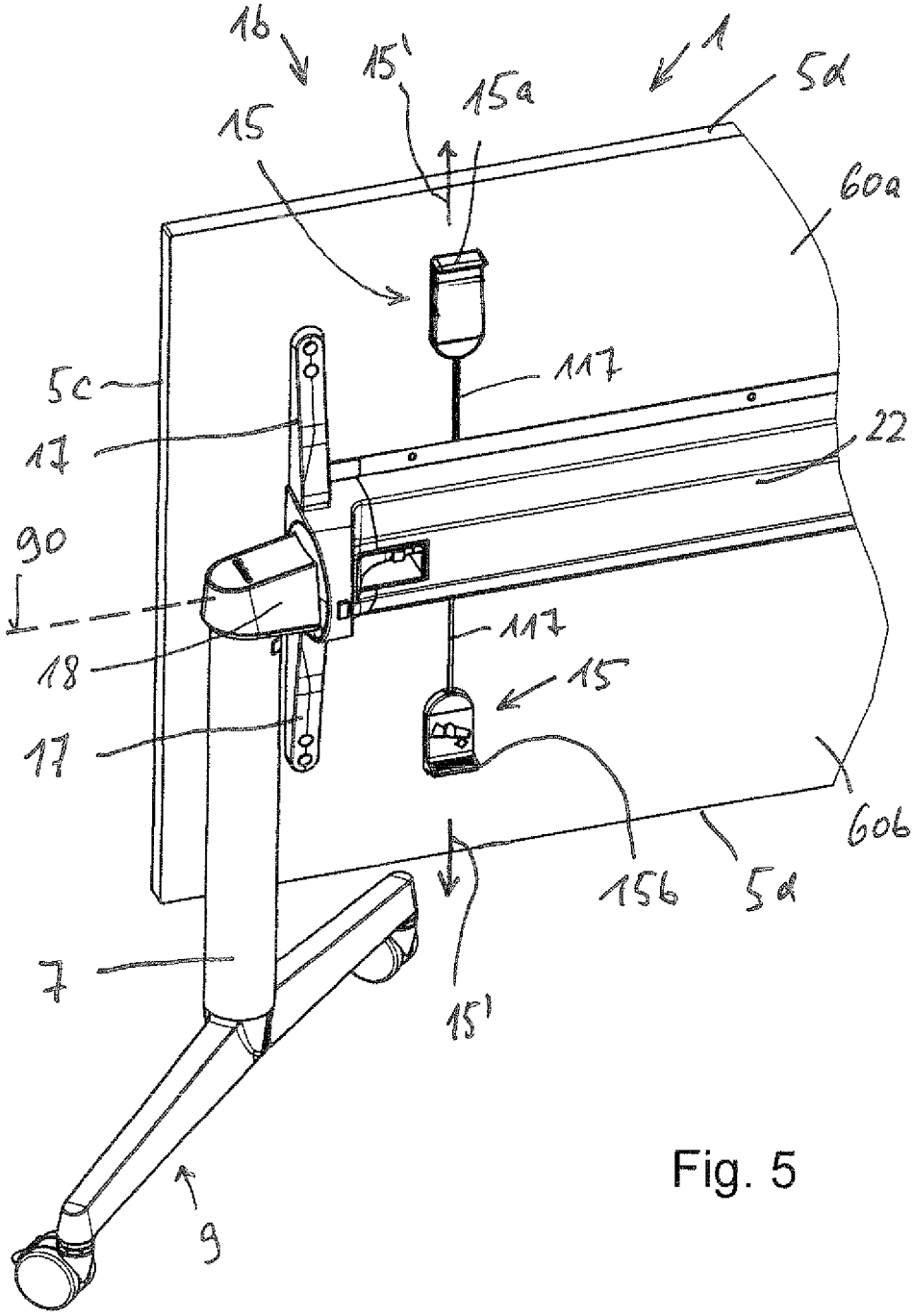
FIG. 5 is a view comparable or similar to FIG. 3*b*, but of a table which can be pivoted into the vertical storage position thereof in one direction only, i.e. on one side only.

FIG. 5 shows an example similar to the example shown in FIG. 3*b*. However, in the embodiment of FIG. 5, the table top 5 is to be adjustable from a conventional operation and work position (generally oriented horizontally) in only one direction about the horizontal axis 90 thereof, for example into the more or less vertically oriented storage position shown in FIG. 5. In this case, the manual disengagement and actuation means 15*a* is only provided on the table half 60*a* which is uppermost in the pivot position, preferably alongside the upper longitudinal edge 5*d* of the table top 5, in such a way that this manual disengagement and actuation means 15*a* is above the horizontal pivot axis 90 in the pivot position thereof. The further actuation or disengagement means 15*b* which can be disengaged by a shoe or a foot is provided on the opposite, second table top half 60*b* (on the underside of the table), i.e. on the table half 60*b* which is below the horizontal pivot axle 90 in the pivot position of the table top 5, and thus also comes to lie below the manual disengagement means 15*a*. This is because the foot disengagement or actuation means 15*b* is only required for initiating the unlocking process in the approximately vertical orientation of the table top, the manual disengagement and unlocking means 15*a* being required for unlocking the table top when the table top is generally located in the horizontal work and use position.

Figure 6:
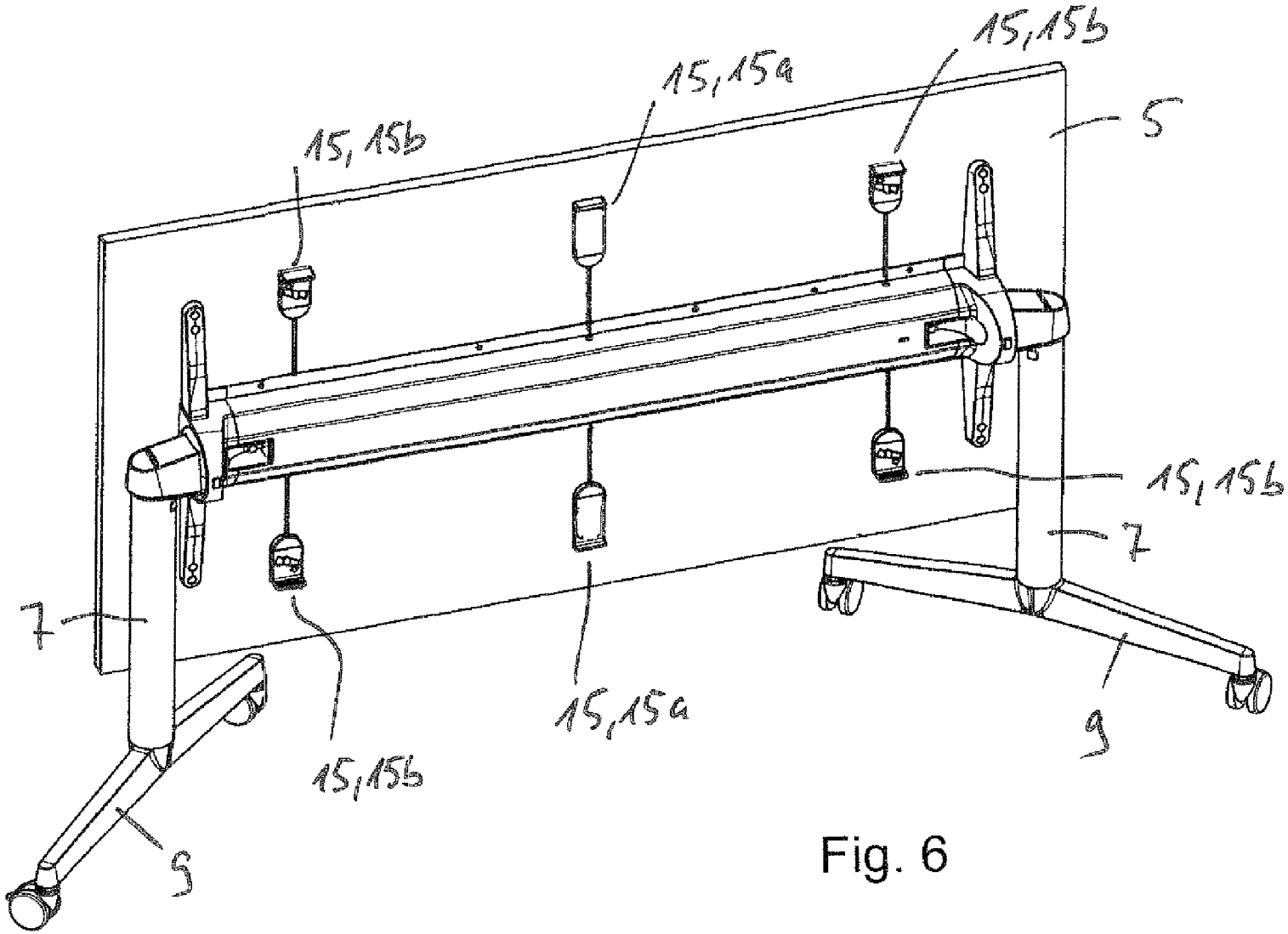
FIG. 6 shows an embodiment which is illustrated as an alternative to FIG. 3*b* and in which the foot-actuatable disengagement means and hand-actuatable disengagement means are arranged mutually spatially offset in the longitudinal direction of the table.

FIG. 6 shows schematically, by way of a further embodiment, that one or more manual disengagement portions 15*a* and in addition one or more foot-actuatable disengagement portions 15*b* may be arranged for example in the longitudinal direction of a table, mutually offset in the longitudinal direction of the table; however, in this case it can never be reliably excluded that the hand-actuatable disengagement portion 15*a*, provided in principle for manual adjustment, might also be moved into the unlocked position by foot when the table top is located in the vertical storage position and is to be unlocked. It also cannot be excluded that when unlocking a generally approximately horizontal orientation of the table top, a hand might grip the disengagement means 15*b*, provided in principle for actuation by foot, instead of the hand-actuatable disengagement portion 15*a*, and for this reason the variants described in relation to FIG. 1 to 4 are preferred.

The invention claimed is:

1. A folding table, comprising:

a table top which is pivotable between a work or use position and an approximately vertically extending storage position, a locking means by which the table top can be locked in the work or use position thereof and in the storage position thereof, the locking means being biased to a locked position by a spring means, a disengagement means located under the table top by which the locking means can be unlocked, the disengagement means comprising first and second hand-actuatable disengagement means, which each can be adjusted relative to the locking means at least with a component transverse to a horizontal pivot axis of the table top or towards a longitudinal edge of the table top, against the force of the spring means, to unlock the table top, wherein the disengagement means further comprises first and second foot-actuatable disengagement means being adjustable relative to the locking means to unlock the table top, wherein the table top is pivotable in two opposite directions about the horizontal pivot axis into the storage position, wherein the first foot-actuatable disengagement means and the first hand-actuatable disengagement means are arranged behind one another in a disengagement direction and spaced apart at a distance (D) on a table half that is below the horizontal pivot axis when the table top is pivoted into the storage position, and the second foot-actuatable disengagement means and the second hand-actuatable disengagement means are arranged behind one another in the disengagement direction and spaced apart at a distance (D) on a table half that is above the horizontal pivot axis when the table top is pivoted into the storage position, wherein each of the hand-actuatable disengagement means has a height (H') extending transverse to the table top, and wherein each of the foot-actuatable disengagement means has a height (H"), raised transverse to the table top, which is greater than the height (H') of the hand-actuatable disengagement means, the height (H'), the height (H"), and the distance (D) defining uneven U-shaped troughs respectively between the first hand-actuatable disengagement means and the first foot-actuatable disengagement means and between the second hand-actuatable disengagement means and the second foot-actuatable disengagement means, and wherein based on an adjacent longitudinal edge of the table top, the first and second hand-actuatable disengagement means are respectively arranged closer to the adjacent longitudinal edge than the first and second foot-actuatable disengagement means.

2. A folding table according to claim 1, wherein the respective hand actuatable disengagement means and foot-actuatable disengagement means are formed on a shared actuation member.

3. A folding table according to claim 2, wherein the hand-actuatable and foot-actuatable disengagement means, which are positioned or formed on a shared actuation member, are adjustable along a guide in a sliding manner.

4. A folding table according to claim 1, wherein a length (L) of each of the foot-actuatable disengagement means is greater than a length of each of the hand-actuatable disengagement means.

5. A folding table according to claim 1, wherein in an actuation direction, the foot-actuatable disengagement means are arranged or dimensioned in such a way as to cover or conceal the respective hand-actuatable disengagement means located behind them.

6. A folding table according to claim 1, wherein the foot-actuatable disengagement means or the hand-actuatable disengagement means are in the form of webs and extend in the longitudinal direction thereof or at least over portions in the longitudinal direction of the table top or parallel to the horizontal pivot axis of the table top.

7. A folding table according to claim 1, wherein the hand-actuatable disengagement means and the respective foot-actuatable disengagement means are mutually offset in the longitudinal direction of the table top.

8. A folding table comprising:

a table top mounted on a support base, the table top being pivotable about a horizontal axis relative to the support base between a use position and a storage position;

a lock assembly operable to selectively lock the table top in the use position and the storage position, the lock assembly being biased toward a locked position by a spring; and a pair of disengagement units, one each disposed on opposite sides of the horizontal axis, each of the disengagement units including a hand-actuatable disengagement member coupled with the lock assembly and displaceable against the spring bias to release the lock assembly, and a foot-operated disengagement member coupled with the lock assembly and displaceable against the spring bias to release the lock assembly, wherein the hand-actuatable disengagement member and foot-operated disengagement member of each of the disengagement units are arranged behind one another and spaced apart in a disengagement direction, wherein each of the hand-actuatable disengagement members has a height (H') extending transverse to the table top, and wherein each of the foot-actuatable disengagement members has a height (H"), raised transverse to the table top, which is greater than the height (H') of the hand-actuatable disengagement members, the height (H'), the height (H"), and a distance between the hand- and foot-actuatable disengagement members defining uneven U-shaped troughs respectively between the first hand-actuatable disengagement member and the first foot-actuatable disengagement member and between the second hand-actuatable disengagement member and the second foot-actuatable disengagement member, and wherein the hand-actuatable disengagement member of each of the disengagement units is positioned closer to a longitudinal edge of the table top than the respective foot-operated disengagement member.

9. A folding table according to claim 8, wherein the hand-actuatable disengagement member and the foot-operated disengagement member of each disengagement unit are formed on a shared actuation member.

10. A folding table according to claim 9, wherein each foot-operated disengagement member protrudes farther from a bottom surface of the table top than the respective hand-actuatable disengagement member.

* * * * *